United States Patent [19]

Harada et al.

[11] 4,166,263

[45] Aug. 28, 1979

[54] MAGNETIC CORE ASSEMBLY FOR MAGNETIZING COLUMNAR PERMANENT MAGNET FOR USE IN ELECTROSTATIC DEVELOPING APPARATUS

[75] Inventors: Hideki Harada, Urawa; Keitaro Yamashita, Kamisatomachi; Katsunobu Yamamoto, Kumagaya, all of Japan

[73] Assignee: Hitachi Metals, Ltd., Tokyo, Japan

[21] Appl. No.: 838,872

[22] Filed: Oct. 3, 1977

[51] Int. Cl.[2] ..... H01F 13/00

[52] U.S. Cl. ..... 335/284; 361/143; 118/658

[58] Field of Search ..... 335/284; 29/607; 118/658; 361/143

[56] References Cited

U.S. PATENT DOCUMENTS

| | | | |
|---|---|---|---|
| 3,158,797 | 11/1964 | Andrews | 335/284 |
| 3,402,698 | 5/1967 | Kojima et al. | 118/658 |
| 3,455,276 | 5/1967 | Anderson | 118/658 |
| 3,828,730 | 5/1972 | Yamashita et al. | 118/658 |
| 3,952,701 | 11/1974 | Yamashita et al. | 118/658 |

FOREIGN PATENT DOCUMENTS

| | | | |
|---|---|---|---|
| 5114800 | 7/1974 | Japan | 335/284 |

*Primary Examiner*—R. N. Envall, Jr.

*Attorney, Agent, or Firm*—Finnegan, Henderson, Farabow & Garrett

[57] ABSTRACT

Disclosed is a magnetic core assembly for magnetizing columnar permanent magnet, particularly columnar ceramic permanent magnet adapted for use in magnetic-brush type electrostatic developing apparatus. The invention is to clarify the magnetic pattern most effective for the development, as well as a construction for presenting such a pattern, and is aiming to provide a magnetizing iron core assembly having an improved construction of magnetic poles and magnetizing coil windings.

5 Claims, 6 Drawing Figures

MAGNETIC CORE ASSEMBLY FOR MAGNETIZING COLUMNAR PERMANENT MAGNET FOR USE IN ELECTROSTATIC DEVELOPING APPARATUS

LIST OF PRIOR ART REFERENCES (37 CFR 1.56 (a))

The following references are cited to show the state of the art:

Japanese Utility Model Laid-Open No. Sho. 51-14800 Keitarou Yamashita et al. July 22, 1974

U.S. Pat. No. 3,455,276 Glenn R. Anderson May 23, 1967

U.S. Pat. No. 3,402,698 Motoki Kojima et al. May 26, 1967

U.S. Pat. No. 3,828,730 Keitarou Yamashita et al. May 16, 1972

U.S. Pat. No. 3,952,701 Keitarou Yamashita et al. Nov. 5, 1974.

BACKGROUND OF THE INVENTION

The present invention relates to a magnetic core assembly for magnetizing a permanent magnet for use in a magnetic-brush electrostatic developing apparatus and, more particularly, to an iron core assembly for imparting a plurality of axially extending magnetic poles on the cylindrical surface of a columnar magnet which is generally referred to as "magnetic roll".

Developers conventionally used in electrostatic developing apparatus for visualizing electrostatic latent image are divided into bicomponent developer consisting of a magnetic carrier and toner particles, and monocomponent developer having magnetic particles contained by toner particles.

Also, there have been two ways of developing latent image by these developers: cascade type method and magnetic-brush type method. In the past, the cascade type method has been commonly used. However, recently, the magnetic-brush type method has been getting popular, because of the so-called edge effect which causes an insufficient development at the central portion of the region to be developed and other drawbacks inherent in the cascade type method.

In the magnetic-brush type developing apparatus, developer particles are conveyed to a zone close to a latent image held on an electrostatic image carrier, in accordance with a rotation of developing roll. A brush-shaped protrusion is formed with the developer particles on the surface of the developing roll, by the magnetic force of a permanent magnet incorporated in the developing roll. The developer particles are transferred to the electrostatic latent image to visualize the latter, as the image is rubbed by the brush-like protrusion of the developer particles, in accordance with the rotation of the developing roll or the movement of the latent image itself.

There have been proposed a variety of types of permanent magnets for the developing rolls of the kind described.

For example, the specification of U.S. Pat. No. 3,455,276 (Anderson) discloses a columnar permanent magnet consisting of a plurality of previously magnetized sector-shaped rubber permanent magnets adhered to the cylindrical surface of a rotary shaft, while the specification of U.S. Pat. No. 3,402,698 of Kojima et al. discloses a developing roll constituted by block-shaped permanent magnets.

Also, it has been acknowledged that the permanent magnet for use in the developing roll is most advantageously made of unitarily formed ceramic permanent magnets. It will be seen that a uniform magnetic flux distribution is obtained along the entire length of an axially extending unitary ceramic permanent magnet, because there are no joints of magnet pieces on the magnetic poles. Specifications of U.S. Pat. Nos. 3,828,730 and 3,952,701 of Yamashita et al exemplarily discloses developing rollers making use of the unitary ceramic permanent magnet.

It is quite difficult to magnetize the unitary ceramic magnet piece. Only Japanese Utility Model Laid-open Publication No. 14800/1976 (Published on Feb. 3, 1976) teaches a broad concept of such a magnetization. However, even this Publication fails to disclose a concrete method of magnetization. Thus, practical magnetizing means for imparting a complicated magnetic pattern to a columnar magnet have not been proposed up to now.

It is therefore an object of the invention to provide magnetizing means capable of imparting to a columnar permanent magnet a specific pattern of magnetic pole arrangement as disclosed in the specification of U.S. Pat. No. 3,952,701, in which a plurality of magnetic poles of same polarity are arrayed in side-by-side relation, so as to form a large magnetic brush of developer particles on the developing pole of the developing roll.

To this end, according to the invention, there is provided an iron core assembly for magnetizing a columnar permanent magnet for use in an electrostatic developing apparatus, comprising:

a plurality of axially extending and circumferentially disposed magnetic poles defining at their radially inner ends a through-bore for receiving a columnar permanent material to be magnetized, the inner ends being adapted to be located in the close proximity of the outer cylindrical surface of the columnar permanent magnet material when the latter is received in the through-bore, and coil windings for magnetizing the magnetic poles received by grooves formed between adjacent magnetic poles, wherein a plurality of magnetic poles for forming developing poles on the columnar permanent magnet materials are wound by a common coil winding received by grooves at both sides of said magnetic poles, so that the magnetic poles may exhibit a same polarity.

The above and other objects, as well as advantageous features of the invention will be understood from the following description of the preferred embodiments taken in conjunction with the attached drawings in which:

DETAILED DESCRIPTION OF PREFERRED EMBODIMENTS

Figure 1:
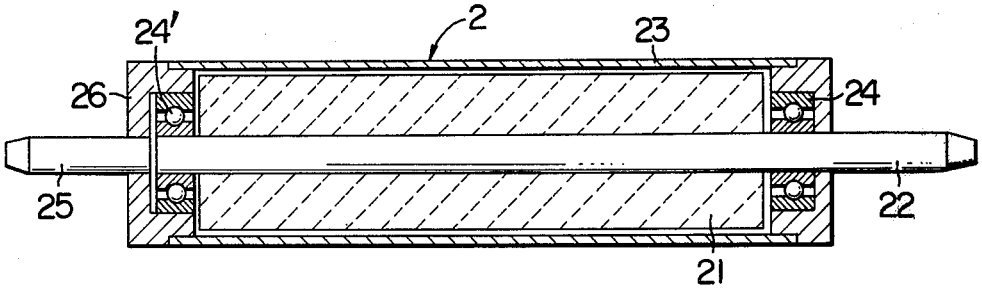
FIG. 1 is a longitudinal-sectional view of a developing roll incorporating a columnar permanent magnet which has been magnetized by means of an iron core assembly in accordance with the invention.
Figure 2:
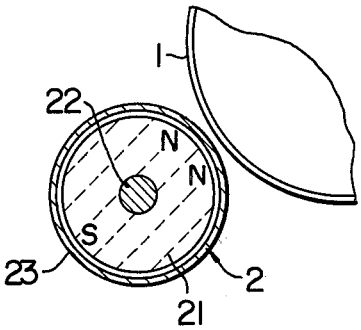
FIGS. 2 and 3 are cross-sectional views of essential parts of an electrostatic developing apparatus having a developing roll incorporating a columnar permanent magnet which has been magnetized by means of the iron core assembly according to the invention.
Figure 3:
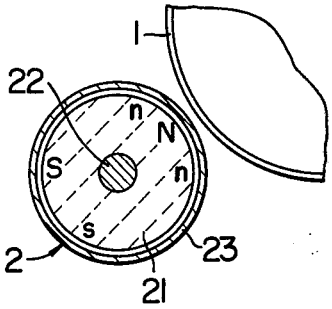

Referring at first to FIGS. 1 thru 3, an electrostatic developing apparatus is shown, consisting of photosensitive body 1 carrying an electrostatic latent image, and a developing roll opposing the photosensitive body in a juxtaposed relation. The developing roll 2 houses a columnar ceramic permanent magnet 21 fixed to a rotary shaft 22. A cylindrical shell 23 made of a non-magnetic material such as a plastic or aluminum is disposed to surround the permanent magnet 21, and is supported by the rotary shaft 22 through bearings 24, 24'. The shell 23 is connected to another rotary shaft 25, through a side plate 26.

The arrangement is such that the permanent magnet 21 is locked against rotation when the rotary shaft 22 is kept stationary, while the cylindrical shell 23 is allowed to rotate by means of the other rotary shaft 25.

The columnar permanent magnet 21 of the developing roller 2 has a plurality of axially extending magnetic poles formed on its cylindrical surface. As will be seen from the drawings, a plurality of magnetic poles of the same polarity are arrayed at the portion of the columnar permanent magnet confronting the photosensitive body 1. More specifically, two magnetic poles having the same polarity and equal magnetic force are disposed in the example as shown in FIG. 2, while, in the example as shown in FIG. 3, a small magnetic pole n is disposed at each side of a large magnetic pole N.

Figure 4:
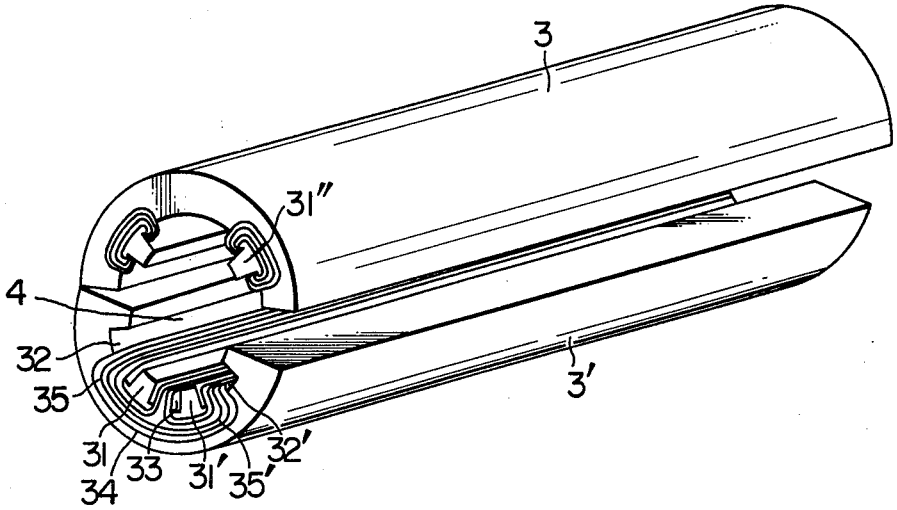
FIG. 4 is a perspective view of an iron core assembly embodying the present invention.

These axially extending magnetic poles can effectively be formed on the cylindrical surface of the columnar permanent magnet 21 by means of an iron core assembly as shown in FIG. 4, in accordance with the present invention.

The iron core assembly is split along a plane passing through the longitudinal axis into complementary iron core segments 3, 3' which define, when coupled with each other, a through-bore 4 having such a diameter as to just receive the columnar magnet material to be magnetized.

The inner peripheral walls of the iron core segments are partially projected radially inwardly, as at 31, 31', 31'' . . . , so as to form the magnetizing yoke. Grooves 32, 33, 32' are formed between adjacent projections 31, 31', 31'' . . . , i.e. between adjacent magnetic poles, and receive magnetizing coil windings 34, 35.

Figure 6:
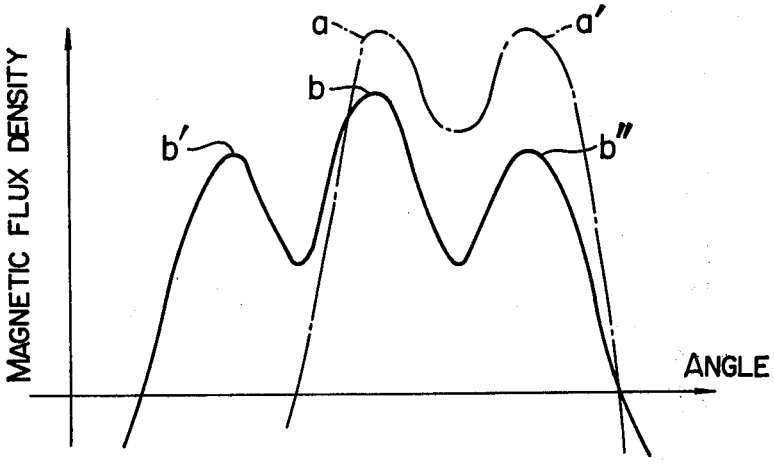
FIG. 6 is an illustration showing the manner of distribution of magnetic flux.

FIG. 4 shows two magnetic poles 31, 31' for magnetizing developing poles. A common coil winding 34 is wound around these magnetic poles 31, 31', so that these poles may exhibit same polarity. It will be seen that the pole arrangement as shown in FIG. 2 results when a permanent magnet material is put in the through-bore 4 and magnetized by these magnetic poles. The resulting permanent magnet 21 will exhibit a magnetic flux distribution as shown in FIG. 6.

Preferably, as shown in FIG. 4, additional coil windings 35, 35' are provided around the magnetic poles 31, 31', respectively. These additional coil windings are supplied with electric currents which flow in the same direction, so that reverse or opposite electric current may appear in the coil windings 35, 35' received by a common groove 33 formed between both magnetic poles 31, 31'. This provision of additional coil windings affords a much stronger magnetic forces on the magnetic poles 31, 31', than those obtained solely by the common coil winding 34.

Figure 5:
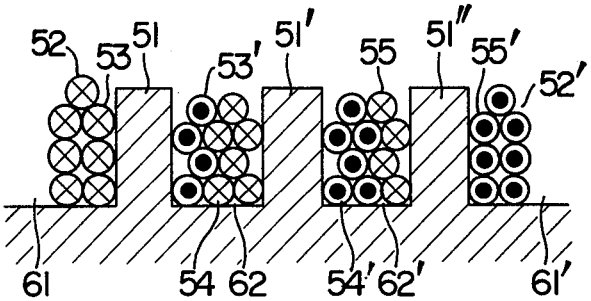
FIG. 5 is an enlarged sectional view of an essential part of the iron core assembly of FIG. 4.

FIG. 5 shows a magnetic pole and coil winding arrangement for forming triple developing poles as shown in FIG. 3.

There are shown three magnetic poles 51, 51' and 51'', as well as grooves 61, 62, 62' and 61' as viewed from left to right, which receive coil windings 52, 53, 53', 54, 54', 55, 55' and 52' as illustrated.

Coil windings 52, 52' are consecutive parts of same coil winding which surrounds the three magnetic poles 51, 51' and 51'' commonly, so as to pass the magnetizing current in the illustrated directions, so that all of these magnetic poles may be magnetized to S.

Coil windings 53, 53' are consecutive parts of same coil winding which is wound around the magnet pole 51. Similarly, the coil windings 55, 55' are consecutive parts of same coil winding going round the magnetic pole 51''. A coil winding having consecutive parts 54, 54' is wound around the central magnetic pole 51'.

By way of example, a columnar permanent magnet 21 having 317 mm length and 54 mm dia. was magnetized to have three peaks of magnetic line of force, i.e. three developing poles. The circumferential width of each magnetic pole was selected to be 3 mm, while the circumferential breadth of the grooves 62, 62' was selected to be 4 mm, respectively. The depth of each groove was 6 mm.

The number of turns of coil windings 52, 53 in total was six (6), as well as the total number of turns of coil windings 55', 52'. The numbers of turns of coil windings 53', 54, 54' and 55 were two (2), respectively. As FIG. 5 shows only exemplarily, the number of turns of coil windings illustrated in the figure differs from this experiment. Magnetizing current of 2000A was passed through each coil winding for magnetizing a columnar permanent magnet material. Consequently, a columnar permanent magnet was obtained to have peaks of magnetic flux density of higher than 700 G and a minimum magnetic flux density of higher than 300 G.

For obtaining a central peak of the magnetic flux density higher than other two peaks, the ampereturn around the central magnetic pole 51' may be selected to be greater than those for other two magnetic poles 51, 51''.

Having described the invention as the specific embodiments, it is to be noted here that various changes and modifications may be imparted thereto without departing from the spirit and scope of the invention which is delimited solely by the appended claims.

What is claimed is:

1. A magnetic core assembly for magnetizing a columnar permanent magnet for use in an electrostatic developing apparatus comprising:

a plurality of axially extending and circumferentially disposed magnetic poles defining at their radially inner ends a through-bore for receiving a columnar permanent magnet material to be magnetized, said inner ends being adapted to be located in close proximity to the outer cylindrical surface of said columnar permanent magnet material received by said through-bore, and coil windings for magnetizing said magnetic poles received by grooves formed between adjacent magnetic poles, wherein a plurality of magnetic poles for magnetizing developing poles on said columnar permanent magnet materials are wound by a common coil winding received in grooves at both sides of said magnetic poles, and wherein each of said plurality of magnetic poles is wound with an additional coil winding, the additional coil winding being so arranged that the current through the additional coil winding received in the groove between said magnetic poles sums in a direction axially opposite to that in said common coil winding.

2. A magnetic core assembly as claimed in claim 1, characterized in that there are provided two magnetic poles for forming two developing poles of the same polarity on the cylindrical surface of said columnar permanent magnet material.

3. A magnetic core assembly as claimed in claim 1, characterized in that there are provided three magnetic poles for forming three developing poles of the same polarity on the cylindrical surface of the columnar permanent magnet material.

4. A magnetic core assembly as claimed in claim 3, wherein the coil winding for the central one of said three magnetic poles has a greater ampere-turn than those for other two magnetic poles.

5. A magnetic core assembly as claimed in claim 1, wherein said core assembly is divided into a plurality of axially extending iron core segments along planes which pass the longitudinal axis of said through-bore.

* * * * *